United States Patent [19]

De Schamphelaere et al.

[11] Patent Number: 4,610,532

[45] Date of Patent: Sep. 9, 1986

[54] TONER DISPENSING CONTROL

[75] Inventors: Lucien A. De Schamphelaere, Edegem; Freddy M. Librecht, Boechout; Willy G. Verlinden, Edegem, all of Belgium

[73] Assignee: Agfa-Gevaert N.V., Mortsel, Belgium

[21] Appl. No.: 613,737

[22] Filed: May 24, 1984

[30] Foreign Application Priority Data

Jun. 3, 1983 [EP] European Pat. Off. ..... 83200802.3

[51] Int. Cl.[4] ..... G03G 15/09

[52] U.S. Cl. ..... 355/14 D

[58] Field of Search ..... 355/3 DD, 14 D; 118/689, 690; 346/153.1, 160

[56] References Cited

U.S. PATENT DOCUMENTS

| | | | |
|---|---|---|---|
| 3,409,901 | 11/1968 | Dost et al. | 355/14 D X |
| 3,529,546 | 9/1970 | Kollar | 355/14 D X |
| 4,032,227 | 6/1977 | Hubbard et al. | 355/14 D |
| 4,190,018 | 2/1980 | Ariotti et al. | 118/690 |
| 4,210,864 | 7/1980 | Miyakawa et al. | 355/3 DD X |
| 4,260,073 | 4/1981 | Baumann | 355/3 DD X |
| 4,342,283 | 8/1982 | Terashima | 355/3 DD X |
| 4,413,264 | 11/1983 | Cruz-Uribe et al. | 355/14 D X |
| 4,468,112 | 8/1984 | Suzuki et al. | 355/14 D |

FOREIGN PATENT DOCUMENTS 57-146263 9/1982 Japan .

*Primary Examiner*—Arthur T. Grimley
*Assistant Examiner*—J. Pendegrass
*Attorney, Agent, or Firm*—William J. Daniel

[57] ABSTRACT

Toner dispensing control in xerographic printing, wherein a toner dispenser is controlled during a first period of use by means measuring the exposing radiation applied to the photoconductor, and during a further period of use by means responsive to the relative permeability of the toner mixture. Thus, over-tonering during the running-in period of a new toner mixture is avoided.

10 Claims, 2 Drawing Figures

TONER DISPENSING CONTROL

The present invention relates to a method and a device for toner dispensing control in a xerographic printer.

In xerographic printers wherein a photoconductor is electrostatically charged, image-wise exposed, and finally developed by contact with a toner mixture attracted thereto from a mixture of magnetically-susceptible carrier particles and toner powder provided in a developing station, there is provided a toner dispenser for adding toner powder to the mixture as the toner powder is being consumed during development of the electro-static charge pattern in order to keep the concentration of the mixture constant.

It is known to control the concentration of the toner mixture by inductively measuring the carrier concentration i.e. the amount of carrier per unit of volume, comparing the actual measured concentration with a set value, and using the deviation between these values as a signal to control the toner dispenser to add toner powder. This control, which is a feedback control, is based on the ferro-magnetic character of the carrier particles, and on variations in the inductance of a coil as a consequence of variations in the concentration of carrier particles within the electro-magnetic field of the coil. Variations in the concentration of carrier particles result in corresponding variations of the relative electrical, especially magnetic, permeability of the toner mixture. This method of control (also known as ATCR: automatic toner control regeneration) is known for instance from co-pending European application No. 83 200 134.1, relating to an apparatus employing a bridge incorporating induction coils for monitoring the concentration of toner in a toner/carrier mixture, and copying apparatus incorporating same.

This method of control does not operate satisfactorily in practice, since it has been shown that there occurs a significant deviation of the correct response of the control, in particular during the running-in period of a new toner mixture, which period may cover the production of some thousands of prints.

During the running-in period of a new developer the carrier packing changes due to the smearing of toner particles or toner additives on the carrier particles. This smearing effect decreases the friction coefficient of the surface of the carrier particles and increases the degree of carrier packing density of the mixture.

In consequence the measurement will indicate an increased amount of carrier particles per unit of volume, and the system will derive therefrom the erroneous conclusion that this has been caused by a reduction in the amount of toner powder, so that the dispenser will be controlled to add more toner powder whereby overtonering occurs. This causes an increase of the fog level on the print, a too high density of the image, and the creation of thick and smeary lines.

It is possible to overcome this difficulty by an "artificial ageing" of a new toner mixture by the manufacturer of the toner mixture. Such procedure cannot perfectly simulate the "ageing" of the toner mixture in normal use, and is economically not attractive since it increases the costprice of the product and at the same time reduces its life, i.e. the number of copies that can be produced with a given amount of carrier particles.

It is also possible to provide the control device with supplementary control means, for instance operated by the optical density measurement of the produced print image (occasionally a test zone or a test pattern thereon), and using a feedback loop from such density measurement to control toner dispensing. However, such an arrangement is expensive.

Finally, it is known to control toner dispensing in an electrophotographic apparatus by integrating signals that are produced by a character generator to produce charge images, and by actuating a toner dispenser as a set valve has been obtained. Suchlike system is disclosed in DE-B No. 1,771,826. It has the disadvantage that in the long run no accurate control of the developer composition is obtained.

It is the object of the present invention to provide an improved method and device for toner dispensing control in a xerographic printer, more particularly in a printer of the type wherein the imagewise exposure of the photoconductor occurs by line-wise exposing the photoconductor by appropriate activation of a plurality of linearly-spaced discrete exposures.

In accordance with the present invention, a method for controlling the dispensing of toner powder in xerographic printing of the type wherein a photoconductor is electrostatically charged and image-wise exposed by line-wise exposing the photoconductor by appropriate activation of discrete spotlike sources of radiation spaced along said line, in response to corresponding data bits, and the electrostatic image thus produced is developed by contact with a toner mixture comprising magnetically susceptible carrier particles and toner powder which is attracted thereto at a developing station provided with a toner dispenser for dispensing toner to the toner-depleted mixture, and wherein a control signal is produced when the relative electrical permeability of the toner mixture deviates from a set or reference value by a predetermined amount, is characterized in that the operation of the toner dispenser is directly controlled by a second control signal obtained by counting the number of data bit signals activating radiation sources during exposure of the photoconductor and producing the second control signal each time a pre-set number of operative radiation sources is attained, and using the second control signal to control the operation of the toner dispenser; while using the first control signal responsive to deviations of the relative permeability of the toner mixture from the set value, to alter the pre-set number of operational sources, and thereby indirectly to control the dispensing of toner.

By the arrangement of the invention, the toner dispenser is directly controlled by a cumulative exposure control signal which is generated periodically in responsive to the occurrence of a selected number of exposures during the xerographic process, the magnitude of the selected number of such exposure being in turn varied by a correction control signal which is generated in response to relative permeability deriation in the toner mixture being used. In such an arrangement using an already stabilized toner mixture, the toner dispenser is effectively controlled by the correction control signal, but the dual signal control allows precise control to be effected during the running-in period. Thus the correction control signal may be attenuated or modulated, and increased progressively during the running period, or it may be blocked completely during the entirety or just partially during the running-in period.

The expression "discrete sources of radiation spaced along said line" denotes in the present specification one or more linear arrays of LED's (light emitting diodes) or like stationary radiators, that may be energized to produce the desired exposure of the photoconductor. The expression includes also a scanner, e.g. a laser scanner, the beam of which is modulated during the scanning to determine during each scan movement a plurality of elementary image sites that may receive radiation or not depending on the modulation of the radiation beam.

The sources of radiation may be sequentially operative, as in a laser printer, but they may also be groupwise operative, as in the case of a linear array of LED's where the recording signal is fed to the LED's through a serial in—parallel out register, and a latch register, so that all the LED's that are required for the writing of one image line, may yet be energized all together during the same period of time.

The developed toner image of the photoconductor may be transferred to another support, e.g. a plain paper sheet, whereon it may be fixed to constitute the final image, but the invention does not exclude a photoconductor where the toner image is fused on the photoconductor itself thereby form the final image. Further, a support with a fixed toner image may also be used after suitable treatment to constitute a planographic printing plate.

The counting of the number of operative sources of radiation may be simply performed by connecting the electric data bit control signal(s) for such sources to a counter that is arranged to count each time one bit as a source is controlled to emit radiation to an elementary image site on the photoconductor. The pre-selected number of operative sources may be attained after several exposures of the photoconductor have been made, but such number may also be attained before the finishing of a first exposure of the photoconductor, for instance in the case of an image containing an important amount of "black", this in contrast with a conventional printed text the total surface of which comprises usually only between 5 and 10% black area.

The determination of the end of the running-in period of a toner mixture is a matter of experience and depends on the particular toner mixture used.

An alteration or change of the pre-selected number of operative radiation sources to be counted, by the deviation of the relative permeability of the carrier particles from a set value, occurs preferably at a controlled rate. A good basis for controlling this rate is formed by the number of actually printed prints or copies, since it is in fact each development operation of the apparatus that contributes to the ageing of the toner mixture.

The invention includes also a device for performing the control of toner dispensing in a xerographic printer.

According to the invention, a toner dispensing control device in a xerographic printer of the type wherein a photoconductor is electrostatically charged, imagewise exposed by line-wise exposing the photoconductor by means of appropriate activation of a plurality of discrete spotlike sources of radiation spaced along said line in response to corresponding data bits, and finally developed by contact with a toner mixture attracted thereto from a mixture of carrier particles and toner powder pivoted in a developing station including a toner dispenser for adding toner powder to the mixture, and a measuring circuit for measuring the relative permeability of carrier particles per unit volume, comparing the measured value with a set value and producing upon deviation of the actual from the set value a control signal, is characterised thereby that the device comprises a pre-selectable data bit counter for counting the operative radiation sources during exposure of the photoconductor and for producing, as a pre-selected number is attained, a control signal for the toner dispenser, and means for altering the setting of the data bit counter in response to deviations of the actual from the set relative permeability of the carrier particles.

The latter response, however, is modulated during the initial running in period of the system, when relative permeability is not a reliable indication, in response to the number of produced prints.

The invention will be described hereinafter by way of example with reference to the accompanying drawings wherein.

Figure 1:
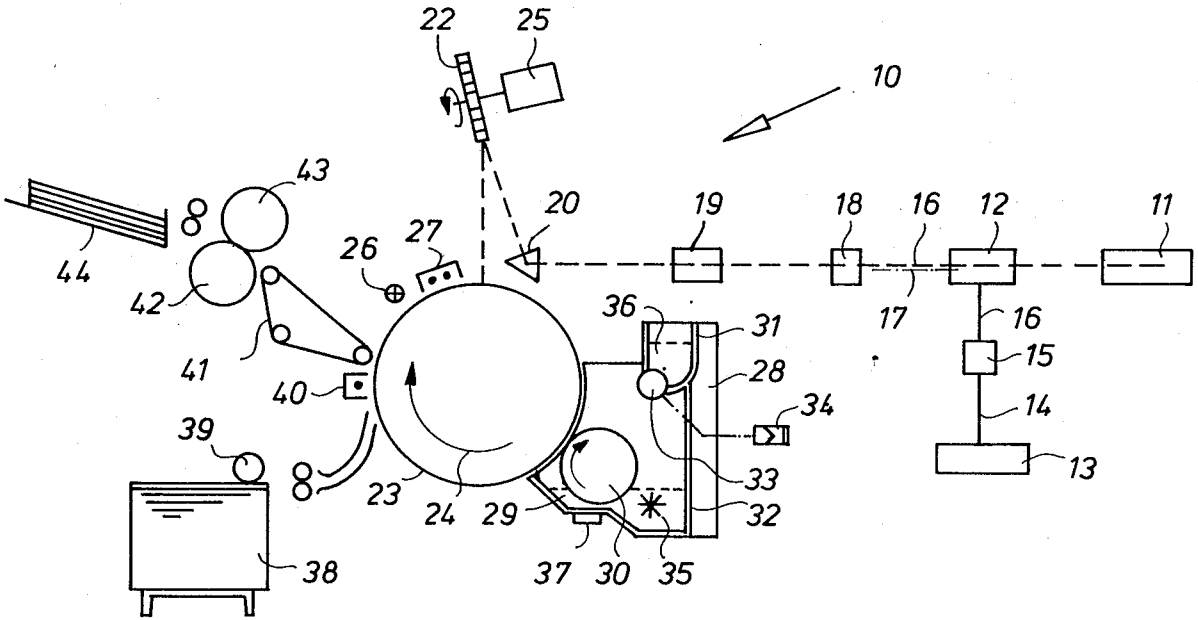
FIG. 1 is a diagrammatic illustration of one embodiment of a laser printer.

FIG. 1 shows a laser printer designated generally 10. A laser light source 11 transmits a collimated light beam to light beam modulator 12. Signals which designate data bits, "ones" or "zeros", from character generator 13 and which represent portions of alphanumeric characters to be printed by the laser printer 10 are sequentially transmitted over line 14 to RF (radio frequency) generator 15. If a "one" bit signal is transmitted, RF generator 15 transmits a RF voltage over line 16 to light modulator 12, otherwise no RF voltage is transmitted. The individual bit signals are gated or clocked from character generator 13 by a character generator clocking signal.

The light beam modulator 12 may be an acousto-optical modulator which, in response to RF voltages, establishes acoustic vibrations which cause a portion of the input radiation beam to be diffracted through a specific angle along a deflected path. The portion of the deflected beam is called the first order beam 16 while the undeflected beam is called the zero-order beam 17.

The modulated beam is then passed through a negative lens 18 and an adjustable positive lens 19 which together co-operate to control the size and focus of the first order beam. From there, the modulated beam impinges on prism 20, and then upon a multifaceted rotating reflection mirror 22 driven by a motor 25.

Rotating mirror 22 acts on the modulated beam reflecting it toward the photoconducting drum 23 while at the same time causing it to sweep repeatedly in fanlike fashion in a plane. In a preferred embodiment, only the first order beam 16 is enabled to impinge upon the surface of the photoconducting drum 23. Hence, when "one" signals are stored in the character generator memory are transmitted as "high bit" or "one" signals to RF generator 15 which causes RF pulses to be transmitted to light beam modulator 12 which in turn causes first order beam 16 to be switched on, then light impinges on photoconducting drum 23 to image a dot thereon.

Photoconducting drum 23 is caused to rotate in the direction of the arrow 24 while the periodically sweeping laser beam traverses a series of parallel straight lines across the surface of the drum. The straight lines are parallel to the axis of the drum.

Rotating mirror 22 is a highly polished multi-faceted mirror rotating several hundreds of revolutions per minute, so that adjacent straight lines traversed on the photoconducting drum 23 may be designed to be approximately 0.0625 mm apart. Since the first order light beam is caused to switch on and off at a RF frequency in the order of magnitude of tens of Megacycles, each straight line path is provided with a large number of possible dot sites, for instance 3456 in a 21 cm straight line segment.

When a first order beam strikes the drum the electrostatically charged drum is locally discharged at the exposure site, so that development of the charge image by a toner charged to the same polarity as the initial charging of the drum, may cause a dark dot to be recorded on the final output of the printer.

When the beam is not present, a white space is left on the print. In this way, alphanumeric characters are printed as a series of dots and no dots in accordance with data bits produced in the character generator.

The processing of the photoconducting drum is as follows. Prior to the dot-wise exposure, drum 23 is uniformly flooded with light from a source 26 in order to completely discharge the photoconductor after the previous exposure. The photoconducting drum 23 is then uniformly electrostatically charged by corona discharge from a charging station 27.

The dot-wise discharged charge pattern remaining after exposure by the laser beam, is developed in a developing station 28 containing a two-component developing mixture 29 which is composed of triboelectrically chargeable toner powder and magnetisable carrier particles, and which is fed to the developing site by a so-called magnetic brush 30 which is a roller with magnets provided in its interior space, whereby a layer of developer mixture is pulled upwardly by the roller as the roller rotates in the illustrated direction. The developing station comprises also a toner dispenser with a toner tank or hopper 31 provided above the developer tank 32 for storing toner powder 36 therein, and has at its lower portion an opening for supplying the toner therethrough, and a toner supplying roller 33 with a mantle of open-cell polymer foam that closely fits to the opening. Stepwise rotation of roller 33 under control of a solenoid 34 that actuates a pawl that engages a toothed pawl wheel fitted on the shaft of the roller (not illustrated), causes the roller to remove at each angular step a controlled amount of powder from the hopper 31, which powder falls by gravity in the developer mixture 29 in the tank 32, and is mixed therewith through the stirring wheel 35. Finally there is provided a measuring coil 37 at the bottom of the developer tank for sensing the relative permeability of the developer mixture.

The developed toner image on the drum 23 is transferred to a plain paper sheet fed from a stack 38 of such sheets. A dispenser roller 39 removes each time the upper sheet from the stack, and feeds it in timed sequence towards the drum 23 so that the leading sheet edge coincides with the leading edge of the toner image on the drum. A transfer corona 40 causes the transfer of the toner image of the drum towards the paper sheet. The sheet is then transported by a belt conveyer 41 towards a fixing station where the toner image is fused into the sheet under the application of heat and pressure by rollers 42 and 43. The prints are finally received in a tray 44.

Figure 2:
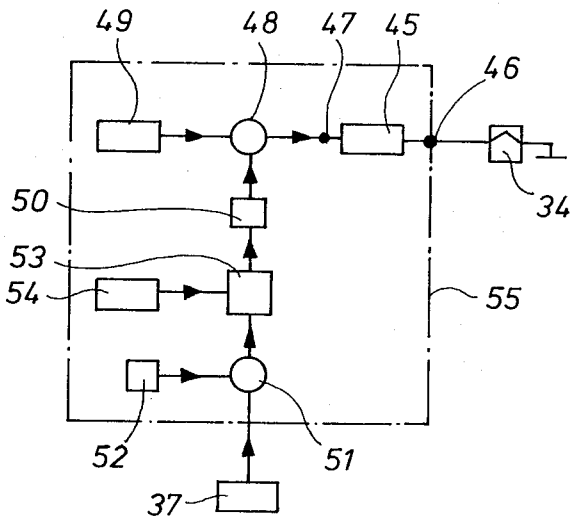
FIG. 2 is a diagrammatic illustration of one embodiment of a toner dispensing control circuit for the printer of FIG. 1.

One embodiment of a toner dispensing control of the printer is illustrated diagrammatically in FIG. 2. The control circuit comprises a signal processor 45 which has an output 46 for the control of the solenoid 34 of the toner dispenser, and an input 47 for receiving the driving signal from comparator 48. The comparator 48 compares the number of data bits counted by a counter 49 with a pre-selected number set in data bit setter 50, and produces a control signal for controller 45 each time the pre-selected number of data bits has been counted. The number of data bits set initially in data bit setter 50 may vary from $10^5$ to $10^7$. The data bit counter 49 may receive its input signal from line 14 in FIG. 1, since each bit on this line corresponds with a black dot on the developed image.

The setting of the circuit 50 is such that, taking into account all the characteristics of the apparatus, such as the photoconductor response, the initial charging at station 27, the electric potential of the magnetic brush 30, the tribo-electric characteristics of the developer mixture, etc., one dispensing operation of the toner dispensing roller 33 is of a nature to add precisely that amount of toner powder to the mixture, that has been removed by the development of the pre-selected number of data bits on the image. It will be clear that the determination of this response is rather a matter of careful examination of the behaviour of the apparatus in practice, rather than of purely theoretical approach. Practice shows that all the concerned parameters remain substantially constant in a good functioning apparatus.

The device comprises further a comparator 51 for producing a control signal as the relative permeability of the carrier particles measured by measuring coil 37 deviates from a value set in the circuit 52.

The rate at which the control signal from 51 has an altering or modulating action on the setting of the data bit setter 50 is determined by the rate control circuit 53 that in turn is responsive to a copy counter 54. The copy counter 54 counts the number of produced prints or copies, and produces thus a signal that is a measure of the time of operation of the printer. The response of the circuit 53 to the copy counter 54 may be such that after a period of time that corresponds with the running-in priod of a new toner mixture, e.g. from 1000 to 3000 of copies, the data bit setting of circuit 50 is altered in response to the output from the circuit 51, so that the toner dispensing proceeds from that moment completely under the control of the relative permeability measuring circuit 37, 51, 52.

From that moment there is a fixed relationship between toner concentration and relative permeability of the carrier particles, so that toner dispenser control on the basis of relative permeability of the carrier particles ensures a reliable control during the entire further life of the toner mixture.

It is, however, also possible to establish the onset of control more progressively. For instance, the circuits 53 and 54 may be arranged in such a way that after a running-in period of 1000 copies, the deviation signal from comparator 51 operates at only for 33% of its magnitude to alter the setting of 50. After a further 1000 copies, the deviation signal may operate for 66% of its magnitude to alter the setting of 50, and after a still further 1000 copies, the bit setter 50 may then be completely controlled by the relative permeability measurement.

As will have become apparent from the disclosure of the specification so far, the term "running-in" is used herein to denote the period of first use of a new toner mixture, after which the measuring of the relative permeability of the carrier particles provides a reliable indication for the toner powder concentration of the toner mixture. This does not exclude that other characteristics of the toner mixture may continue to alter after said first period of use, provided their impact on the wanted relationship is negligable.

The pre-setting circuits such as blocks 50 and 52 may be provided as distinct elements and arranged for easy setting by the operator of the printer. However they may also be incorporated in the electronic circuitry of the printer and be programmed for performing the desired functions. In a preferred arrangement of the control circuitry of the printer, the functions of all the blocks situated within the periphery of the block 55 illustrated in broken lines, are performed by a microprocessor.

The following example illustrates the improved operation of a printer according to the invention over a prior art printer that was operated exclusively according to the ATCR mode.

Type of printer: a laser type printer with a selenium coated drum for producing prints on standard DIN A4 format plain paper.

Type of toner mixture:
carrier weight: 600 g
toner weight: 28.8±1.8 g
toner concentration: 4.8±0.3% by weight
Average toner consumption: 0.7 mg/cm2
Setting of bit setter 50: $5.10^6$ bits
Setting of print counter 54: 1000 prints
Lifetime of carrier: 50,000 prints.

It was shown that a good control of the concentration of the developer mixture was obtained during the running-in as well as during the further lifetime of the mixture. If the same xerographic printer was operated with the toner concentration control adjusted in accordance with the prior art mode, namely a relative permeability measurement only, then it was found that as a consequence of increasing packing density during the running-in of a new mixture, the system produced an overtonering up to 1%, which resulted in a too high density of the developed images, and in an increase of the linewidth which gave the impression of a too heavy a text.

It is clear that the invention is not limited to the described embodiment of a printer.

A laser printer can comprise a galvanometer controlled mirror to sweep the recording beam, rather than a multi-faceted mirror wheel as illustrated.

The printer can comprise a multiplicity of stationary radiation sources, rather than a moving radiation beam. An example of the latter type of printer is formed by so-called LED array printers wherein LED chips are arranged in linear fashion to provide one or two rows of LED's that extend transversely of the path of movement of a photoconductor, and that are focussed, occasionally through self-focusing fibers or the like, onto the photoconductor surface.

It will be understood that a printer according to the invention will comrise many other control means, known in the art, that are indispensable for an easy operation of the apparatus. The printer will include for instance means that signals the near exhaustion of the toner powder so that the toner dispenser may be timely replenished, means that signals the end of the operative life of the carrier particles, means that signals an anomaly with paper feeding, etc. The printer may also be arranged for the automatic resetting of the print counter when a used developer mixture is replaced by a fresh one.

The operation of the toner dispensing device need not necessarily occur by the stepwise rotation of a toner dispensing roller under the control of a solenoid, but such roller may also be driven otherwise, e.g. by a small servo-motor with appropriate reduction gear, and control means to set the time of rotation of the roller upon each toner dispensing operation.

We claim:

1. A method for controlling the dispensing of toner powder in xerographic printing of the type wherein a photoconductor is electrostatically charged and imagewise exposed by line-wise exposing the photo-conductor by appropriate activation of discrete spotlike sources of radiation, spaced along said line, in response to corresponding data bits, and the electrostatic image thus produced is developed by contact with a toner mixture comprising magnetically susceptible carrier particles and toner powder which is attracted thereto and including a source of fresh toner powder operable to add such fresh powder to said toner mixture in a generally given incremental rate upon the application thereto of a control signal: comprising generating a control signal in response to repetitive accumulation of a selected number of data bit signals activating said exposure sources during exposure and applying the thus generated control signal to said toner powder source to operate the latter to add fresh toner powder; measuring the electrical permeability of said toner mixture and determining when said measured permeability value deviates from a reference value; and varying the selected number of such accumulated data bit signals generating said control signal in response to a deviation between said measured permeability and said reference value.

2. The method of claim 1, wherein said selected number of accumulated data bits is varied normally at a given rate in response to said measured deviation and modulating said normally given rate of such variation in response to the occurrence of at least one predetermined condition.

3. The method of claim 2, wherein the number of printed copies is counted and at least one selected number of the thus counted copies is utilized as said predetermined condition.

4. The method of claim 1, wherein said step of varying said selected number of said accumulated data signals in response to said deviation is delayed at the initiation of printing until the occurrence of a predetermined condition.

5. The method of claim 4, wherein said condition corresponds to a given interval of toner dispensing.

6. The method of claim 1, wherein said data bit signals are accumulated by counting the same.

7. A toner dispensing control device in a xerographic printer of the type including exposed means wherein a photoconductor is electrostatically charged and imagewise exposed by line-wise exposing the photoconductor by means of activation of a plurality of linearly-disposed discrete sources of radiation in response to a series of corresponding data bits, and developing means for developing said photoconductor by contact with a toner mixture attracted thereto from a mixture of magnetically-susceptible carrier particles and toner powder, including a source of fresh toner powder operable to add such fresh powder to said toner mixture in a generally given incremental rate upon the application thereto of a control signal: comprising means generating a control signal in response to repetitive accumulation of a selected number of data bit signals activating said exposure sources during exposure and applying the thus generated control signal to said toner powder source to operate the latter to add fresh toner powder; means for measuring the electrical permeability of said toner mixture and determining when said measured permeability value deviates from a reference value; and means for varying the selected number of such a-cumulated data bit signals generating said control signal in response to such deviation between said measured permeability and said reference value.

8. The device of claim 7, wherein said selected number of accumulated data bits is varied normally at a given rate in response to said measured deviation and including means for modulating said normally given rate of such variation in response to the occurrence of at least one predetermined condition.

9. The device of claim 8, wherein the number of printed copies is counted and including means for utilizing at least one selected number of the thus counted copies as said predetermined condition.

10. The device of claim 7, including means for delaying said step of varying said selected number of said accumulated data bit signals in response to said deviation after the initiation of printing until the occurrence of a predetermined condition.

* * * * *

UNITED STATES PATENT AND TRADEMARK OFFICE

CERTIFICATE OF CORRECTION

PATENT NO. : 4,610,532

DATED : September 9, 1986

INVENTOR(S) : Lucien A. De Schamphelaere et al

It is certified that error appears in the above-identified patent and that said Letters Patent is hereby corrected as shown below:

In the Claims:

Column 8, line 56 (claim 7, line 5), "disposed" should read -- displaced --.

Signed and Sealed this

Twenty-eighth Day of October, 1986

[SEAL]

*Attest:*

DONALD J. QUIGG

*Attesting Officer* *Commissioner of Patents and Trademarks*